United States Patent [19]

Jacobs

[11] 4,071,036

[45] Jan. 31, 1978

[54] HOLDER FOR ELONGATE TOBACCO PRODUCT

[76] Inventor: James D. Jacobs, 1030 Old Orchard Drive, Wauseon, Ohio 43567

[21] Appl. No.: 747,886

[22] Filed: Dec. 6, 1976

[51] Int. Cl.[2] ..... A24F 13/02

[52] U.S. Cl. ..... 131/187; 131/229

[58] Field of Search ..... 131/187, 170 R, 171 R, 131/189, 190, 229

[56] References Cited

U.S. PATENT DOCUMENTS

| | | | |
|---|---|---|---|
| 249,848 | 11/1881 | May | 131/187 |
| 608,170 | 8/1898 | Bigelow | 131/187 |
| 1,743,481 | 1/1930 | Rench | 131/187 |
| 1,815,919 | 7/1931 | Lake | 131/229 |
| 3,921,645 | 11/1975 | Hagman | 131/187 X |

*Primary Examiner*—Stephen C. Pellegrino

*Attorney, Agent, or Firm*—Allen D. Gutchess, Jr.

[57] ABSTRACT

A holder is provided for cigars and similar tobacco products. In a preferred form, the holder includes a mouthpiece portion and a receiver portion which can be easily disassembled and assembled. The mouthpiece portion has a chamber therein for a filter insert, the insert preferably being of tobacco which can be flavored, but it can also be of other materials, such as snuff. The mouthpiece portion has a side opening therein which provides access to the insert so that the smoker can touch and taste the insert with his tongue as well as draw smoke from a lighted cigar held by the receiver portion. The mouthpiece portion also has an arcuate groove in front of the opening to fit with the lower teeth of the smoker and to help maintain the holder in a position with the side opening facing downwardly.

8 Claims, 7 Drawing Figures

HOLDER FOR ELONGATE TOBACCO PRODUCT

This invention relates to a holder for tobacco products and specifically for cigars.

The cigar holder according to the invention is intended to promote the use of cigars over cigarettes by smokers. As such, the holder should improve the national health since smokers tend to inhale cigar smoke much less than they do cigarette smoke, thereby protecting the lungs, heart and throat from possible diseases.

Many people do not smoke cigars because they dislike having the ends of the cigars directly in their mouths. When this is overcome by employing filters on the cigars or by using conventional cigar holders, the cigar is separated completely from the mouth of the smoker and he fails to obtain the taste and feel of the cigar.

The holder according to the invention has a chamber in which a tobacco insert is received, with the holder having an opening at the side of the mouthpiece through which the smoker can feel and taste the insert with his tongue. The insert provides a filtering action and can also be flavored with such flavoring as rum, wine, apple, scotch, or menthol, by way of example. The insert preferably also has an outer tobacco wrap or leaf to eliminate the use of the paper ordinarily surrounding cigarettes.

The new holder thus does not require the end of the cigar itself to be held in the smoker's mouth and yet the smoker can obtain the taste, sense and pleasure of the insert which cannot be achieved with conventional cigar holders or even cigars with filters on the ends. With tobacco used as the insert, being a preferred form, it also provides a good filtering action since tobacco itself is an effective filter.

It is, therefore, a principal object of the invention to provide a holder for cigars and the like which will promote cigar smoking in place of cigarette smoking.

Another object of the invention is to provide a holder for elongate tobacco products containing a filter insert which can be flavored.

A further object of the invention is to provide a holder for elongate tobacco products having an insert which can be touched by the smoker's tongue through an opening in the side of the holder.

Yet a further object of the invention is to provide a holder for cigars or the like which contains an insert made of tobacco wrapped in tobacco leaves and which can be sensed in the smoker's mouth.

Many other objects and advantages of the invention will be apparent from the following detailed description of preferred embodiments thereof, reference being made to the accompanying drawings in which.

Figure 1:
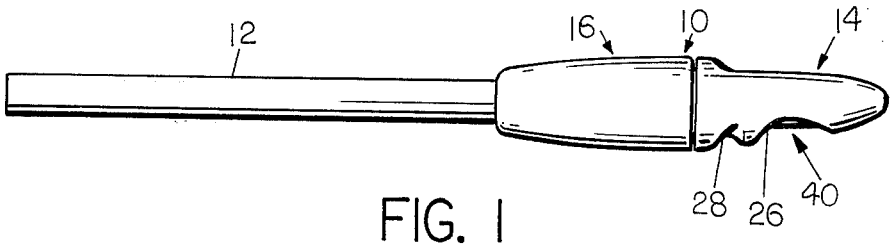
FIG. 1 is a side view in elevation of a cigar and a holder in accordance with the invention.
Figure 2:
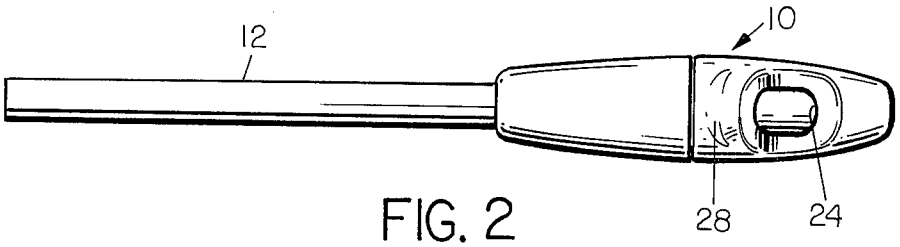
FIG. 2 is a bottom view of the cigar and the holder.
Figure 3:
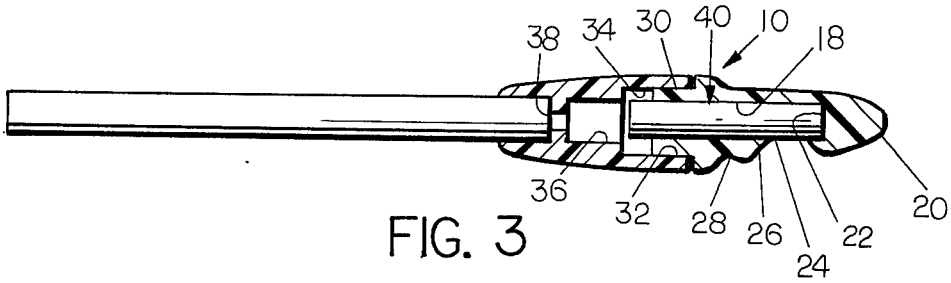
FIG. 3 is a view similar to FIG. 1 but with the holder in longitudinal cross section.
Figure 4:
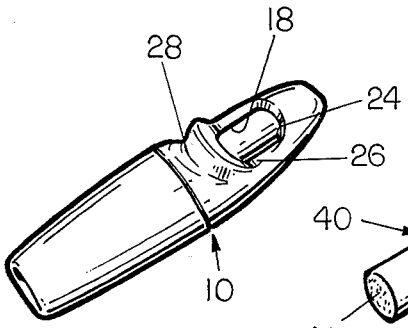
FIG. 4 is a bottom view in perspective of the holder.

Referring to the drawings and particularly to FIGS. 1-4, a holder for an elongate tobacco product is indicated at 10 and is shown as holding a little cigar 12. The holder can be made of a variety of materials including cherry wood, briar root, ebonite, or plastic materials commonly used in cigar and cigarette holders. In the preferred form, the body of the holder 10 is made in two portions, a mouthpiece portion 14 and a cigar or tobacco product receiver portion 16. The mouthpiece portion 14 has a cylindrical chamber 18 therein which extends from the outer end thereof toward but stopping short of a blunt inner end 20 of the mouthpiece, the chamber 18 terminating in a squared end 22. An elongate opening 24 in the side of the mouthpiece communicates with the chamber 18, the opening 24 being formed where a shallow transverse groove 26 of the mouthpiece portion intersects the chamber 18. In front of the opening 24 is an arcuate groove 28 formed across the mouthpiece portion 10 and is designed to cooperate with the lower teeth of the smoker to position the opening 24 downwardly above the tongue of the smoker. A forwardly extending projection 30 enables the mouthpiece portion 14 to be easily assembled with and disassembled from the receiver portion 16.

The receiver portion 16 has a large recess 32 at the end toward the mouthpiece with the recess 32 being deeper than the projection 30 to form a chamber 34 even when the portions 14 and 16 are fully assembled. The chamber 34 communicates with a passage 36 extending from the chamber 34 to the outer end of the receiver portion 16. An annular shoulder 38 is formed at an intermediate portion of the passage 36 to receive and position an end of the cigar 12. It may be noted that the outer surfaces of the portions 14 and 16 near the projection 30 and recess 32 are of equal size and shape to provide a smoothly contoured joint therebetween.

Figure 5:
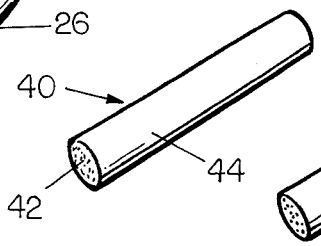
FIG. 5 is a perspective view of an insert for the holder.

In accordance with the invention, an insert 40 can be positioned in the chamber 18, fitting closely therein and abutting the end 22 of the chamber. A portion of this insert protrudes through an opening 24 at the groove 26 so that it is accessible by the tongue of the smoker. This enables the smoker to obtain the feel and taste of the insert. In a preferred form, the insert is made of tobacco 42 in FIG. 5 and wrapped with a covering or tobacco leaf 44. As such, the insert 40 is similar to the cigar 12 and the smoker can touch the insert to obtain the feel and taste of the cigar without having the complete end of a cigar held in his mouth. The tobacco 42 provides a good filter for smoke from the cigar 12 and the tobacco leaf 44 eliminates the use of paper as found around cigarettes. If desired, the covering or leaf 44 can have small holes formed therein to provide a degree of porosity and increase the passage of smoke from the cigar to the smoker through the opening 24. Also, the size of the opening 24 can exceed the diameter of the insert 40 to provide easier draw for the smoker. The tobacco 42 also provides the smoker with the tobacco aroma and taste which could not be obtained from a conventional holder. However, if desired, the insert can be provided with various flavors such as rum, wine, scotch, apple, menthol, etc. or can be replaced by snuff.

Figure 6:
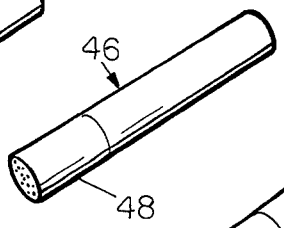
FIG. 6 is a perspective view of a modified insert for the holder.

For further filtering action, a modified insert 46 of FIG. 6 can be employed. This insert can be similar to that of FIG.5 but can have a filter 48 at an end thereof for further filtering action. The filter 48 is placed at the outer end of the mouthpiece portion 14 so that the smoker still obtains the touch and taste of the tobacco portion of the insert. If desired, the mouthpiece portion 14 and the insert 40 or 46 could be used in combination as a mouthpiece for a tobacco pipe or similar smoking device.

With both of the inserts 40 and 46, the outer end stops short of the passage 36 of the receiver portion 16 of the mouthpiece. This enables the smoke from the cigar 12 to enter through the passage 36 and into the chamber 34 before entering the insert 40. This provides a longer time for the smoke to move from the cigar to the smoker's mouth and enables the smoke to correspondingly cool more and seem milder.

Figure 7:
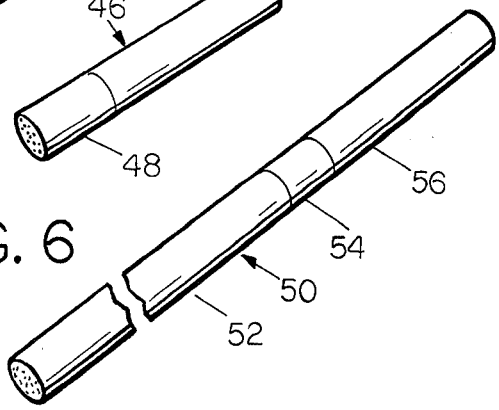
FIG. 7 is a fragmentary view in perspective of a modified cigar usable with the holder.

A further modified combination cigar and insert is shown at 50 in FIG. 7. In this instance, the combination product 50 includes an outer cigar portion 52 which can be similar to the cigar 12 with an intermediate filter 54 which can be similar to the filter 48 of the insert 46 and, further, an insert portion 56 which can be similar to the insert 40. In this instance, the shoulder 38 of the receiver portion 16 of the holder 10 is eliminated and the combination product 50 can be inserted through the passage 36 completely to the end 22 of the chamber 18. If desired, the holder 10 can then be of a one-piece construction. It may be noted that in all cases, the tobacco portion of the insert is exposed at the opening 24.

Various modifications of the above-described preferred embodiments of the invention will be apparent to those skilled in the art, and it is to be understood that such modifications can be made without departing from the scope of the invention, if they are within the spirit and the tenor of the accompanying claims.

I claim:

1. A holder for an elongate tobacco product comprising a body having an outer end and an inner end, said body forming a passage extending from the outer end toward but stopping short of the inner end, said body having an opening communicating between an inner end portion of said passage and a side portion of said body, said passage being of sufficient size substantially throughout its length at least to the inner end portion thereof to receive an insert, whereby the tongue of a smoker can contact the insert in said passage through said opening when the inner end of said body is in the smoker's mouth, said body comprising two body portions, an inner body portion having the inner end and the inner end of said passage and an outer body portion having the outer end and the outer end of said passage, one of said body portions having a recess and the other of said body portions having a projection to be received and held in said recess whereby said body portions can be disassembled to facilitate inserting the insert in the passage and removing it from the passage, said body portions forming a chamber at an intermediate portion of said passage between the insert in the passage and an elongate tobacco product received in the outer end of the passage.

2. A holder according to claim 1 characterized by said body having only one transverse, arcuate groove therein adjacent said opening on the side thereof opposite said inner end whereby said groove can receive lower teeth of the smoker when the end is in the smoker's mouth to orientate the opening on the lower side of said body for access by the upper surface of the smoker's tongue.

3. A holder according to claim 1 characterized by an insert being in said passage with an end of said insert located adjacent the inner end of said passage and having a side portion projecting outwardly through said opening.

4. A holder according to claim 3 characterized by the insert having a tobacco section which includes the portion extending through the opening, and a filter at the end toward the outer end of said body.

5. A holder for cigars or the like comprising a body having an inner mouthpiece and an outer cigar receiver, said mouthpiece and said receiver having mateable portions enabling said mouthpiece and said holder to be assembled and disassembled, said receiver having a passage extending therethrough, said mouthpiece having a passage extending from the mateable portions partly through said mouthpiece, said passage being of sufficient size to receive an insert substantially throughout its length, said mouthpiece having an opening on the side thereof communicating with an end portion of said mouthpiece, and an insert in said mouthpiece passage exposed through said opening, said mouthpiece having a shallow, transverse groove extending thereacross at said opening, with said opening being of sufficient size that a side portion of said insert projects into said shallow, transverse groove, whereby the tongue of a smoker can more readily contact the projecting side portion of the insert.

6. A holder according to claim 5 characterized by said mouthpiece having a single arcuate groove adjacent said opening on the side toward said receiver to cooperate with the lower teeth of a smoker to orientate the opening on the lower side of said body for access by the upper surface of the smoker's tongue.

7. A holder according to claim 5 characterized by the insert in said inner passage comprising tobacco having a covering therearound, and having a filter at the outer end thereof.

8. A holder according to claim 7 characterized by said insert having a cigar portion extending beyond the holder and affixed to the outer end of said filter.

* * * * *